US008888359B2

(12) United States Patent
Altenhoven et al.

(10) Patent No.: US 8,888,359 B2
(45) Date of Patent: Nov. 18, 2014

(54) TIMEPIECE DISPLAY MECHANISM

(71) Applicant: ETA SA Manufacture Horlogere Suisse, Grenchen (CH)

(72) Inventors: Thierry Altenhoven, Delemont (CH); Marco Bettelini, Preles (CH)

(73) Assignee: ETA SA Manufacture Horlogére Suisse, Grenchen (CH)

( * ) Notice: Subject to any disclaimer, the term of this patent is extended or adjusted under 35 U.S.C. 154(b) by 0 days.

(21) Appl. No.: 13/944,280

(22) Filed: Jul. 17, 2013

(65) Prior Publication Data

US 2014/0029391 A1 Jan. 30, 2014

(30) Foreign Application Priority Data

Jul. 24, 2012 (EP) ..... 12177696

(51) Int. Cl.

| | |
|---|---|
| ***G04B 27/02*** | (2006.01) |
| ***G04B 31/008*** | (2006.01) |
| ***G04F 7/08*** | (2006.01) |
| ***G04B 27/00*** | (2006.01) |
| ***G04B 27/04*** | (2006.01) |

(52) U.S. Cl.

CPC ..... *G04B 27/00* (2013.01); *G04B 31/0087* (2013.01); *G04B 27/026* (2013.01); *G04F 7/0866* (2013.01); *G04B 27/04* (2013.01)

USPC ..... 368/190

(58) Field of Classification Search

CPC ..... G04B 27/00; G04B 27/026; G04B 27/04; G04B 31/0087; G04B 27/02; G04B 37/064; G04B 27/001; G04F 7/0866

USPC ..... 368/190–195, 145–146, 185, 308, 319

See application file for complete search history.

(56) References Cited

U.S. PATENT DOCUMENTS

| | | | | |
|---|---|---|---|---|
| 7,275,859 | B2 * | 10/2007 | Forsey et al. | 368/191 |
| 7,862,226 | B2 * | 1/2011 | Bracher et al. | 368/190 |
| 2013/0148479 | A1 * | 6/2013 | Peters et al. | 368/127 |

FOREIGN PATENT DOCUMENTS

| | | |
|---|---|---|
| CH | 188369 | 12/1936 |
| JP | 62-251690 | 11/1987 |

OTHER PUBLICATIONS

European Search Report issued Jan. 23, 2013, in European Application No. 12 17 7696 filed Jul. 24, 2012 (with English Translation).

* cited by examiner

*Primary Examiner* — Edwin A. Leon

(74) *Attorney, Agent, or Firm* — Oblon, Spivak, McClelland, Maier & Neustadt, L.L.P.

(57) ABSTRACT

A timepiece movement including a time-setting stem which is moveable longitudinally and in rotation along a stem axis in a bottom plate, the movement including at least one display control mechanism which includes at least one counter, an arbour of which pivots about a pivot axis. The axis is secant with the stem axis, and pivots in a first jewel, a first external shoulder of which is driven into the bottom plate, and a second external shoulder of which pivotally guides the bore of an intermediate time-setting wheel controllable via the stem.

10 Claims, 1 Drawing Sheet

TIMEPIECE DISPLAY MECHANISM

This application claims priority from European Patent Application No. 12177696.7 filed Jul. 24, 2012, the entire disclosure of which is incorporated herein by reference.

FIELD OF THE INVENTION

The invention concerns a timepiece movement comprising a time-setting stem which is moveable longitudinally and in rotation along a stem axis in a bottom plate, said movement comprising at least one display control mechanism which comprises at least one counter whose arbour pivots about a pivot axis.

The invention also concerns a timepiece comprising at least one movement of this type.

The invention concerns the field of timepiece display mechanisms and more specifically the field of chronographs.

BACKGROUND OF THE INVENTION

In timepieces with multiple displays, inserting a plurality of counters, each dedicated to the display of a particular magnitude, often causes problems, in certain already very crowded areas of the movement, in particular in proximity to the stem for controlling time-setting, and, in some cases, for controlling winding and/or the adjustment of other magnitudes, such as the date, day, month, time zone or other magnitude.

It is known to position the pivot pin of this type of counter in the bottom plate, connected to the gear train. This arrangement has the drawback of moving the gear train away from the display control mechanism, whose counter is one of the peripheral display members. This gear train is conventionally disposed on a train bar, and away from the gear train area.

SUMMARY OF THE INVENTION

The invention proposes to improve the positioning of this type of counter, by housing it as close as possible to the time-setting control mechanism, to enable the largest possible display diameter to be covered, while improving pivoting quality compared to the prior art.

The invention also proposes to make the counter close to the stem, independent of the gear train.

The invention therefore concerns a timepiece movement comprising a time-setting stem which is moveable longitudinally and in rotation along a stem axis in a bottom plate, said movement comprising at least one display control mechanism which includes at least one counter, an arbour of which pivots about a pivot axis, characterized in that said arbour is secant with said stem axis, and pivots in a first jewel, a first external shoulder of which is driven into said bottom plate, and a second external shoulder of which pivotally guides the bore of an intermediate time-setting wheel controllable via said stem.

The invention also concerns a timepiece including at least one timepiece movement of this type, characterized in that said timepiece is a wristwatch.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figures 1, 2:
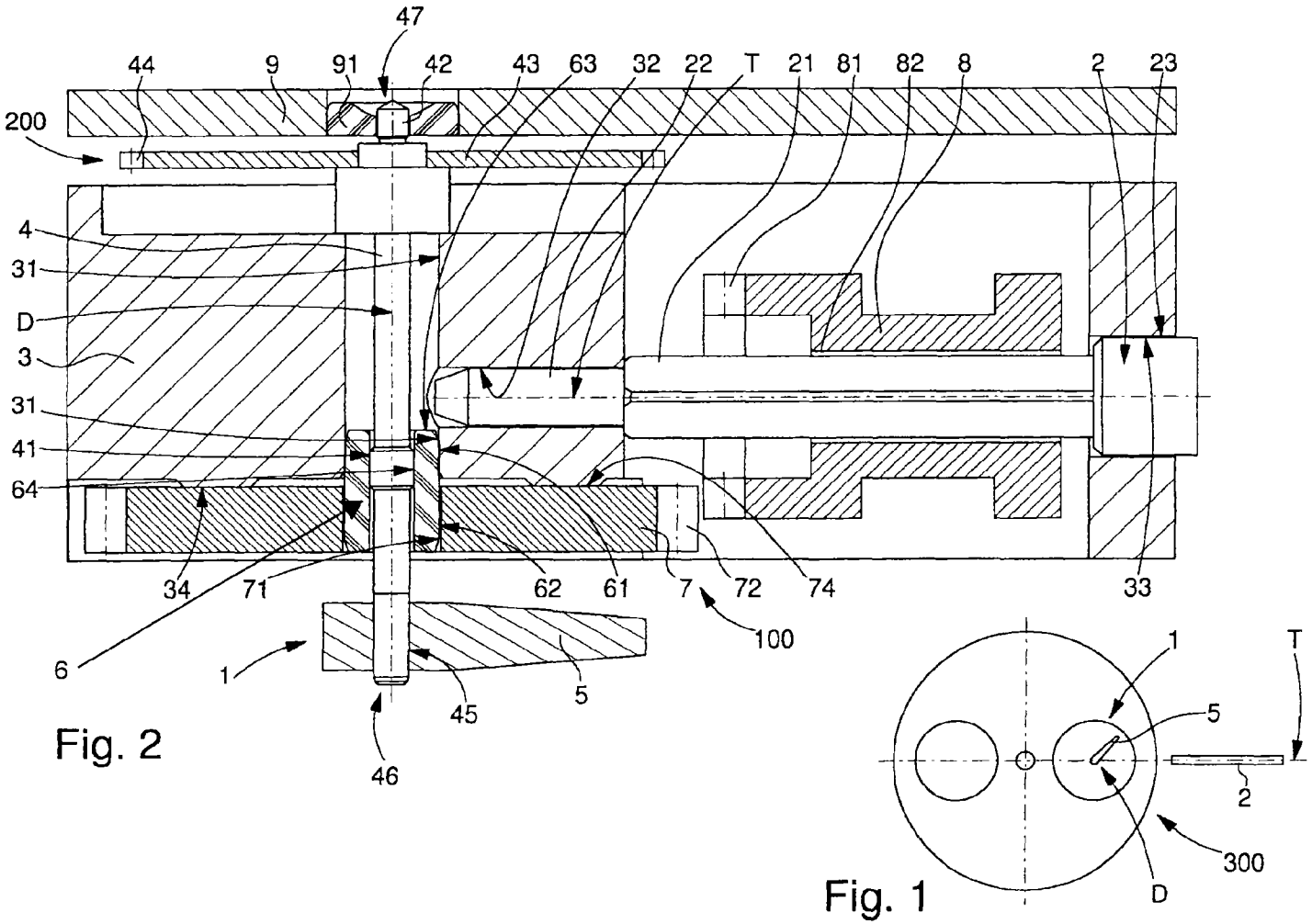
FIG. 1 shows a schematic frontal view of a timepiece formed by a wristwatch, provided with a time-setting stem at 3 o'clock, and comprising a display counter also arranged at 3 o'clock, very close to the time-setting system.
FIG. 2 shows a schematic, frontal cross-section, in a plane through the stem axis and perpendicular to the plane of the bottom plate of the watch, of a detail of a movement comprising a counter of this type, and the interaction thereof with the time-setting mechanism.

The invention concerns a timepiece movement 100.

This movement 100 comprises a time-setting stem 2 which is moveable longitudinally and in rotation along a stem axis T in a bottom plate 3.

Movement 100 comprises at least one display control mechanism 200, which includes at least one counter 1, an arbour 4 of which pivots about a pivot axis D.

According to the invention, this arbour 4 is secant with stem axis T and pivots in a first jewel 6. This first jewel 6 is mounted along axis T of stem 2 and comprises a first external shoulder 61, which is driven into bottom plate 3 and a second external shoulder 62, which pivotally guides the bore 71 of a time-setting wheel 7 controllable via stem 2. Preferably, as seen in FIG. 2, the first external shoulder 61 and the second external shoulder 62 are juxtaposed, and together form a surface of revolution about pivot axis D. Preferably, first external shoulder 61 and second external shoulder 62 are cylindrical and have the same diameter.

In a preferred embodiment, bottom plate 3 has a bore 31 along pivot axis D, into which first shoulder 61 is driven. Bottom plate 3 conventionally comprises, along stem axis T, a first front bore 32 guiding a first front shoulder 22 of stem 2 and a second back bore 33 guiding a second back shoulder 23 of stem 2.

Preferably, jewel 6 is entirely on one side of first front bore 32, on the side of a first end 46 of arbour 4, as seen in FIG. 2. It is in proximity to this first end 46 that arbour 4 is guided, by a spool 41 comprised therein, in a bore 64 in first jewel 6. Preferably, this spool 41 is guided in an inner surface which is at the same level as first external shoulder 61, the spool is thus firmly held, without jutting out relative to bottom plate 3. Jewel 6 has an end face 63 which is recessed from first front bore 62 or tangent thereto. During assembly, this arrangement enables a runner to be inserted into bore 62 before the stem is assembled, to limit the depth to which first jewel 6 is driven into bore 31 of bottom plate 3, which automatically ensures the desired length dimension of each of shoulders 61 and 62.

In short, first jewel 6 has a triple function:

- the first shoulder 61 on its external diameter is used to hold first jewel 6 in bottom plate 3;
- the second shoulder 62 on its external diameter is used for pivoting intermediate time-setting wheel 7;
- the inner diameter 64 is used for pivoting spool 41 of arbour 4.

In a particular embodiment, bottom plate 3 comprises at least one fillet 34 arranged to cooperate, with minimum friction, with a bearing surface 74 of intermediate time-setting wheel 7, for limiting the shake of intermediate time-setting wheel 7 relative to bottom plate 3.

Movement 100 preferably comprises a train bar 9, which includes a second jewel 91 in which there pivots a pivot 42 comprised in arbour 4 at a second end 47 opposite first end 46.

The display control mechanism 200 comprises a train meshing with a toothing 44 comprised in a counter wheel 43 which pivots integrally with arbour 4, and which is located in intermediate proximity to train bar 9. This arrangement is advantageous, since, in a particular case where display control mechanism 200 is a chronograph mechanism, it is thus possible to power counter arbour 4 at the same height as train bar 9, in the same way as the other counters, which was not possible in the prior art where positioning a counter aligned with the stem required a shift of altitude relative to the other counters.

As seen in FIG. 2, intermediate time-setting wheel 7 includes a toothing 72 arranged to mesh, in certain longitudinal positions of stem 2, with a frontal toothing 81 which comprises a sliding pinion 8 pivoting integrally with stem 2 about stem axis T and longitudinally moveable along stem axis T, via a conventional arrangement of a male square 21 of stem 2 cooperating with a female square 82 of sliding pinion 8.

Preferably, arbour 4 carries, at first end 46 thereof more distal from second shoulder 62 of first jewel 6, a hand bearing shoulder 45 for receiving a display hand 5 of counter 1.

The invention finds advantageous but non-limiting application where display control mechanism 200 is a chronograph mechanism.

The invention also concerns a timepiece 300 including at least one such movement 100, and in particular a timepiece 300 which is a wristwatch.

In short, the invention enables a hand 5 of a counter 1 to be positioned on axis T of time-setting stem 2, more particularly in the 3 o'clock position of the stem relative to watch 300.

The invention allows the counter arbour to be powered at the same height as train bar 9, like the other counters of display control mechanism 200.

Arbour 4 of counter 1 is thus made independent of the other counters.

Intermediate time-setting wheel 7 benefits from high quality pivoting on second shoulder 62 of first jewel 6, unlike numerous usual embodiments where the jewel setting is often a collet machined straight into bottom plate 3, and is subject to wear.

Sliding pinion 8 meshes straight onto intermediate time-setting wheel 7 and in a very compact manner, and the height of the movement 100 thereby achieved is reduced.

The invention also allows the use of a standard arbour 4, which pivots on bottom plate 3 and on a train bar 9.

What is claimed is:

1. A timepiece movement comprising a time-setting stem which is moveable longitudinally and in rotation along a stem axis in a fixed bottom plate, said movement comprising at least one display control mechanism which includes at least one counter, one arbour of which pivots about a pivot axis, wherein said arbour is secant with said stem axis, and pivots in a first jewel, a first external shoulder of which is driven and fixed into said bottom plate, and a fixed second external shoulder of which pivotally guides the bore of an intermediate time-setting wheel controllable via said stem.

2. The movement according to claim 1, wherein, along said pivot axis, said bottom plate includes a bore into which said first shoulder is driven and, along said stem axis, a first front bore guiding a first front shoulder of said stem and a second back bore guiding a second back shoulder of said stem, and wherein said jewel is wholly on one side of said front bore, and wherein said jewel comprises an end face which is recessed from said first front bore or tangent thereto.

3. The movement according to claim 1, wherein said first external shoulder and said second external shoulder are juxtaposed and together form a surface of revolution about said pivot axis.

4. The mechanism according to claim 3, wherein said first shoulder and said second shoulder are cylindrical and have the same diameter.

5. The movement according to claim 1, wherein said bottom plate includes at least one fillet arranged to cooperate, with minimum friction, with a bearing surface of said intermediate time-setting wheel to limit the shake of said intermediate time-setting wheel relative to said bottom plate.

6. The movement according to claim 1, wherein it includes a bar comprising a second jewel in which there pivots a pivot comprised in said arbour at a second end, opposite a first end, close to which said arbour cooperates, via a spool, with a bore of said first jewel, and wherein said display control mechanism includes a train meshing with a toothing comprised in a counter wheel which pivots integrally with said arbour and in immediate proximity to said bar.

7. The movement according to claim 1, wherein said intermediate time-setting wheel includes a toothing arranged to mesh, in certain longitudinal positions of said stem, with a frontal toothing comprised in a sliding pinion which pivots integrally with said stem about said stem axis and is moveable longitudinally along said stem axis.

8. The movement according to claim 1, wherein said arbour carries, at a first end more distal from said second shoulder of said first jewel, a hand bearing shoulder for receiving a display hand of said counter.

9. The movement according to claim 1, wherein said display control mechanism is a chronograph mechanism.

10. The timepiece including at least one movement according to claim 1, wherein said timepiece is a wristwatch.

* * * * *